US012533550B2

(12) United States Patent
Davenport et al.

(10) Patent No.: US 12,533,550 B2
(45) Date of Patent: Jan. 27, 2026

(54) SYSTEMS AND METHODS FOR TRAINING AND TESTING LOWER EXTREMITIES

(71) Applicant: Cybernetic Sport Innovations LLC, Westborough, MA (US)

(72) Inventors: Shane Davenport, Westborough, MA (US); Sean Smith, Westborough, MA (US)

(73) Assignee: Cybernetic Sport Innovations LLC, Westborough, MA (US)

( * ) Notice: Subject to any disclaimer, the term of this patent is extended or adjusted under 35 U.S.C. 154(b) by 0 days.

(21) Appl. No.: 18/632,938

(22) Filed: Apr. 11, 2024

(65) Prior Publication Data

US 2024/0252883 A1 Aug. 1, 2024

Related U.S. Application Data

(63) Continuation of application No. 17/711,829, filed on Apr. 1, 2022, now Pat. No. 12,157,034.

(60) Provisional application No. 63/169,720, filed on Apr. 1, 2021.

(51) Int. Cl.

| | |
|---|---|
| ***A63B 23/04*** | (2006.01) |
| ***A63B 21/00*** | (2006.01) |
| ***A63B 21/068*** | (2006.01) |
| ***A63B 23/035*** | (2006.01) |

(52) U.S. Cl.

CPC ..... *A63B 23/0405* (2013.01); *A63B 21/068* (2013.01); *A63B 21/151* (2013.01); *A63B 21/4009* (2015.10); *A63B 21/4034* (2015.10); *A63B 23/03525* (2013.01); *A63B 2220/51* (2013.01); *A63B 2220/833* (2013.01)

(58) Field of Classification Search

CPC ..... A63B 21/0023; A63B 21/4009; A63B 21/4034; A63B 21/068; A63B 21/151

See application file for complete search history.

(56) References Cited

U.S. PATENT DOCUMENTS

| | | | | |
|---|---|---|---|---|
| 4,589,658 | A * | 5/1986 | Gibson | A63B 21/4001 482/97 |
| 5,924,933 | A * | 7/1999 | Pacheco | A63B 69/3608 473/277 |
| 6,181,647 | B1 * | 1/2001 | Tipton | A63B 5/16 368/110 |
| 7,608,025 | B1 * | 10/2009 | Best | A63B 21/0023 482/148 |
| 9,873,013 | B2 * | 1/2018 | Williams | A63B 21/0023 |
| 9,993,715 | B2 * | 6/2018 | Merkel | A61B 5/1116 |
| 11,097,145 | B2 * | 8/2021 | Kelly | A63B 21/4033 |
| 2013/0153332 | A1 * | 6/2013 | Marzilger | A63B 21/15 182/3 |
| 2019/0344115 | A1 * | 11/2019 | Neuhaus | A63B 21/0058 |
| 2019/0344123 | A1 * | 11/2019 | Rubin | A63B 21/153 |

(Continued)

*Primary Examiner* — Zachary T Moore

(74) *Attorney, Agent, or Firm* — Taylor Dykema PLLC; Eric Kleinertz

(57) ABSTRACT

The present disclosure may be a lower extremity training system comprising: a plate comprising: an upper surface, and a lower surface, wherein the lower surface is configured to interface with a floor; one or more grip sections disposed upon the upper surface, the one or more grip sections configured to accept one or more mounts; one or more force sensors coupled to the one or more mounts.

20 Claims, 11 Drawing Sheets

(56) References Cited

U.S. PATENT DOCUMENTS

2020/0289873 A1* 9/2020 Charnitski ..... A63B 21/068
2020/0330814 A1* 10/2020 Gigerl ..... A63B 21/0442

* cited by examiner

SYSTEMS AND METHODS FOR TRAINING AND TESTING LOWER EXTREMITIES

CLAIM OF PRIORITY

This application claims priority from U.S. Provisional Patent Application No. 63/169,720, filed on Apr. 1, 2021, and U.S. patent application Ser. No. 17/711,829, filed on Apr. 1, 2022, the contents of which are incorporated herein by reference.

FIELD OF THE INVENTION

The present invention relates to lower extremity training and testing. Specifically, the present invention relates to training and testing lower extremity strength through force exertions on immovable objects.

INTRODUCTION

Training lower extremities can improve athletic performance. For example, thigh strength is associated with sprint speed and vertical jump performance. However, training lower extremities can be difficult or involve bulky equipment. For example, the equipment may use up a lot of space and include a heavy rack that may be bolted to the ground.

Traditionally, such system may utilize an immobile rack and a substantial weight that would prevent the user from moving. Next, the user would attempt to deadlift a bar attached to the immobile rack. However, such a system requires a number of heavy components requiring substantial setup effort and time. Further, such traditional systems are limited in that said systems are configured merely to train and/or measure the single metric of applied force. Thus, such traditional systems limit the user's mobility and free-range motion during a training or testing session.

Moreover, traditional IMTP includes a number of limitations, specifically limitations pertaining to the upper body. Accordingly, the involvement of the upper body and spine in traditional IMTP causes inaccurate readings regarding lower body force production. Such limitations with traditional IMTP emanate heavily from the fact that the user must utilize their arms and back when pressing upward against the immobile rack and bar. The use of upper extremities in this style of training and testing may cause grip and other upper extremity injuries. In addition, to physiological limitations of such systems, traditional IMTP setups are costly due to the quantity and size of the required equipment. Such equipment often requires bolting the unit to flooring or loading the equipment with massive quantities of weights. Thus, setup is difficult, costly, and time consuming. As a further limitation, a user cannot easily evaluate their jump with such traditional systems. For example, to test an athlete's jump, one must relocate all the weights and then attempt to collect data. Further, in order to once again test strength, the weights must once again be loaded onto the IMTP rig. This alone may require several minutes because the user must re-calibrate the rig in order accurately collect data.

Therefore, it would be desirable to provide systems and methods configured to train lower extremity strength without cumbersome and unwieldy equipment. It would be further desirable to provide systems capable of both training lower extremity strengths and measuring lower extremity strength. Even further yet, it would be desirable to provide a system capable of facilitating training and testing of a user's lower extremity strength in view of their mobility, such as jumping. Additionally, it would be desirable to provide a system for providing lower extremity training while minimizing upper body muscle actuation.

SUMMARY

This Summary is provided to introduce a selection of concepts in a simplified form that are further described below in the Detailed Description. This Summary is not intended to identify key features or essential features, nor is it intended to limit the scope of the claims included herewith.

Provided may be a lower extremity training system comprised of, a plate comprised of, an upper surface, and a lower surface, wherein the lower surface is configured to interface with a floor; one or more grip sections disposed upon the upper surface, the one or more grip sections configured to accept one or more mounts; one or more force sensors coupled to the one or more mounts.

In an embodiment, the lower extremity training system further comprises, a hook orthogonal to the upper surface; a strap reversibly coupled to the hook; and a belt reversibly coupled to the strap, the belt sized to conform to a waist of a user, wherein the strap includes a fixed length, and wherein a pull force, originating at the belt, exerted away from the upper surface induces one or more push forces towards the upper surface.

In another embodiment, the strap is reversibly coupled to the hook via a quick link, and wherein the quick link is disposed between the strap and the hook. Additionally, the strap is reversibly coupled to the belt via a coupling link, and wherein the coupling link is disposed between the strap and the belt.

In a further embodiment, the lower extremity training system is further comprised of a base disposed between the hook and the plate. Moreover, the base further comprises one or more mounting holes and a hook hole, wherein the one or more mounting holes are threaded such as to accept one or more fasteners, one or more fasteners are configured to affix the base to the plate, and wherein the hook hole is sized to accept the hook. Furthermore, the hook is welded to the base.

In yet a further embodiment, the one or more force plates are comprised of, a first force plate; and a second force plate, the first force plate disposed upon a first half of the upper surface, and the second force plate disposed upon a second half of the upper surface, wherein the hook is disposed between the first force plate and the second force plate such that the user may access said hook.

BRIEF DESCRIPTION OF THE DRAWINGS

Objects, aspects, features, and advantages of embodiments disclosed herein will become more fully apparent from the following detailed description, the appended claims, and the accompanying drawing figures in which like reference numerals identify similar or identical elements. Reference numerals that are introduced in the specification in association with a drawing figure may be repeated in one or more subsequent figures without additional description in the specification in order to provide context for other features, and not every element may be labeled in every figure. The drawing figures are not necessarily to scale, emphasis instead being placed upon illustrating embodiments, principles and concepts. The drawings are not intended to limit the scope of the claims included herewith.

DETAILED DESCRIPTION

In the following detailed description, reference will be made to the accompanying drawing(s), in which identical functional elements are designated with like numerals. The aforementioned accompanying drawings show by way of illustration, and not by way of limitation, specific aspects, and implementations consistent with principles of this disclosure. These implementations are described in sufficient detail to enable those skilled in the art to practice the disclosure and it is to be understood that other implementations may be utilized and that structural changes and/or substitutions of various elements may be made without departing from the scope and spirit of this disclosure. The following detailed description is, therefore, not to be construed in a limited sense.

It is noted that description herein is not intended as an extensive overview, and as such, concepts may be simplified in the interests of clarity and brevity.

All documents mentioned in this application are hereby incorporated by reference in their entirety. Any process described in this application may be performed in any order and may omit any of the steps in the process. Processes may also be combined with other processes or steps of other processes.

Figure 1A:
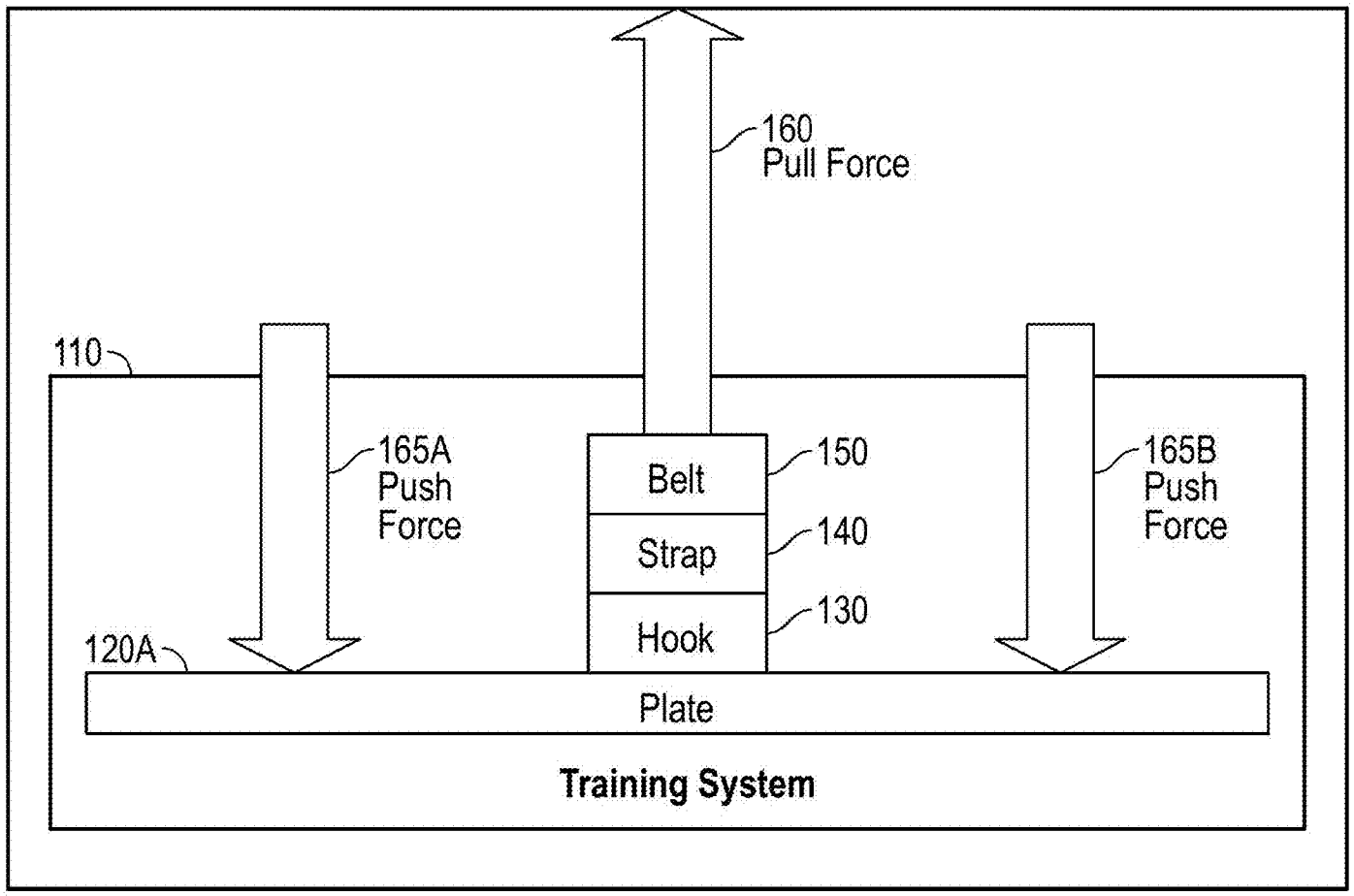
FIG. 1A illustrates a block diagram depicting an embodiment of the system for training lower extremities.

Referring now to FIG. 1A, FIG. 1A illustrates a block diagram depicting an embodiment of the training system 110 for lower extremities. The training system 110 can include a plate 120A (generally referred to as plate 120). The plate 120 can include a hook 130. The training system 110 can also include a strap 140 and a belt 150.

The plate 120 can be a metal plate configured to receive force. The plate 120 can be rectangular or any other shape. In various embodiments, the pate may be 30"×24.5"×0.5", 28"×20"×0.5", or any other suitable dimensions. The plate 120 may be aluminum and/or may include a steel sore. However, the plate 120 may be composed of any suitable material, for example a metal or other material capable of withstanding force from the user. The plate 120 can include a flat surface. For example, the plate 120 may include both an upper surface and a lower surface. In such an embodiment, the lower surface may be configured and sized to rest flat upon a gym floor, for example. The upper surface may be configured and sized to accept the user's feet. In some embodiments, the plate can include a grip for the user to stand on. In such an embodiment, the upper surface may include an additional grip surface or coating configured to enhance the grip between the user's shoes and the plate 120. In a further embodiment, the lower surface may include an additional grip surface or coating configured to increase friction between the plate 120 and the floor (for example, to decrease sliding of the plate 120).

The hook 130 is included in the plate 120. The hook 130 may be part of the plate 120 or otherwise attached to the plate 120. The hook 130 can include a metal ring, magnetic materials, or any other attachment mechanism configured to connect to the strap 140. In an embodiment, the hook 130 includes threads and the plate 120 includes a threaded hole sized to accept the threads of the hook 130. In a further embodiment, a base is disposed between the hook 130 and the plate. The base may be a rectangular, generally flat, member comprising one or mounting holes and one or more hook holes. The one or more mounting holes may be sized to accept fasteners, such that the fasteners may hold the base to the plate. In such an embodiment, the plate may comprise an equal number of mounting receiving holes aligned with the one or more mounting holes of the base. Similarly, the plate may include one or more hook receiving holes aligned with the one or more hook holes of the base. Thus, the force felt on the hook 130 during operation of the system may be distributed across the base, the one or more fasteners, and the plate. The hook 130 may be threaded and screwed into the base and/or plate. However, in a further embodiment, the hook 130 may be placed in contact with the base, the plate, and/or any receiving holes therein, and may be welded in position. The weld may provide improved strength of the connection between the hook 130 and the plate 120. In yet a further embodiment, the base may also be welded to the plate 120.

The strap 140 is an elongated flap, ribbon, or rope. In an embodiment, the strap 140 is a chain. For example, a chain strap 140 may be less likely to deform under force; thus, readings may be more accurate and consistent. The strap 140 can include a proximal end configured to couple to the hook 130. The proximal end can include a loop, a magnet, or any other attachment mechanism. The strap 140 can have a fixed length. The fixed length can be 1, 2, 3, 4, 5, 6, 7, 8, 9, or 10 feet. The strap 140 can include leather or fabric. The strap 140 may include a webbing design such that the strap 140 is high-strength strap 140 that can maintain its structural integrity when pulled. The strap 140 can include a distal end. The distal end can include a loop, a magnet, or any other attachment mechanism configured to couple to the belt 150.

The belt 150 can be a band or strap worn around a user's waist. The belt 150 can be an athletic belt, such as those designed for weightlifting, sled training, or any other physical exercise or training. The belt 150 can be adjustable to accommodate various waist sizes. The belt 150 can include a buckle to secure the belt to the user. The belt 150 includes leather, plastic, cloth, or any other fabric. In an alternate embodiment, the belt 150 may be replaced and/or supplemented with a harness attached to the user's body. For example, the belt 150 may be replaced and/or supplemented with a should harness wrapped over the user's shoulders. In yet another alternate embodiment, the belt 150 may be replaced and/or supplemented with a bar, wherein the bar is attached to the strap 140. As a non-limiting example, the user may plant their feet on the plate 120 and grasp the bar, pulling upwards on the bar, such that a force is felt downward on the plate 120. Utilization of a bar may enable the system to accurately target and/or incorporate upper body extremities.

When the user stands on the plate 120A while wearing the belt 150 connected to the plate 120 via the strap 140 and hook 130, the user can exert a pull force 160 away from the plate 120. Since the user is standing on the plate 120A, the user would simultaneously exert pushing forces 165A-B (generally referred to as push force 165) on the plate 120A. For example, the user can exert push force 165A with one leg, and push force 165B with their other leg.

However, the training system 110 can accommodate any number of push forces 165 from the user. For example, a disabled user may exert only one push force 165 or any number of push forces 165. However, the plate 102 may be sized such that a force applied solely on one side of the plate 102 does not cause the plate 102 to flip or slip from under the user. For example, the plate 102 may be sufficiently weighted and/or a suitable width to maintain the position of the plate 102 regardless of the magnitude or direction of force acted upon it.

Figure 1B:
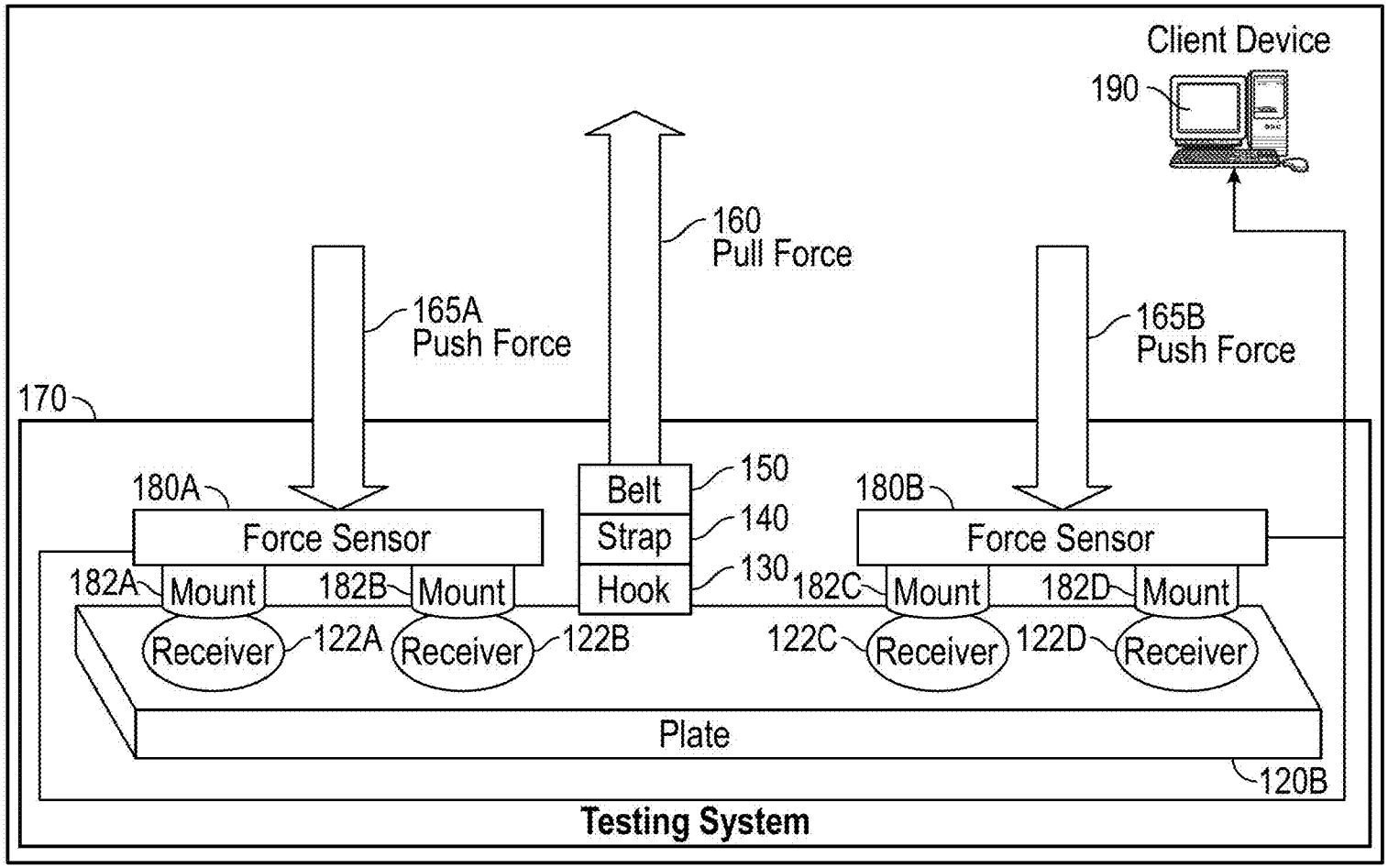
FIG. 1B illustrates a block diagram depicting an embodiment of the system for testing lower extremities.

Referring now to FIG. 1B, FIG. 1B illustrates a block diagram depicting an embodiment of a testing system 170 for lower extremities. The testing system 170 can include the hook 130, the strap 140, and the belt 150 as previously described herein. The testing system 170 can also include a plate 120B, which includes one or more receivers 122A-122D (generally referred to as receivers 122). The testing system 170 can further include force sensors 180A-180B (generally referred to as force sensor 180), which include mounts 1 82A-1 82D (generally referred to as mounts 182).

The receivers 122 can be disposed anywhere on the plate 120B. Each receiver 122 can be a hole, cavity, or a port drilled or engraved into the plate 120B. In a further embodiment, described herein, each receiver 122 may be a section of friction enhancing material or grip tape sized to accept the one or more mounts 182. The receiver 122 includes dimensions for receiving corresponding mounts 182 from any number of force sensors 180. The receivers 122 can include magnets or any other attachment mechanism to couple to the corresponding mounts 182 from the force sensors 180. However, in an embodiment, the mounts 182 rest atop or partially within the receivers 122 without the use of additional attachment mechanisms. In such an embodiment, the push force 165 may aid in maintaining the position of the mounts 182 over the receivers 122.

The force sensor 180 can measure forces applied to the force sensor 180. The force sensor 180 can be a force plate such as, but not limited to, those provided by HAWKIN DYNAMICS of Westbrook, ME. The force sensor 180 can be a single force plate or a bilateral force plate. The force sensor 180 can include load cells that measure values corresponding to the push forces 165 applied to the load cells. The force sensor 180 can transmit the values to the client device 190, for example via Bluetooth. The force sensor 180 can include mounts 182.

The mounts 182 can couple to the receivers 122 to couple the force sensor 180 to the plate 120B. The mounts 182 can extend from the force sensor 180 to position the force sensor on the plate 120B. The mounts 182 can include metallic rods, magnets, or any other attachment mechanism. The mounts 182 can couple to the receivers 122 such that the force sensor 180 remains stationary on the plate 120B regardless of any vertical or horizontal force applied to the testing system 170.

The client device 190 can interface with the force sensor 180. The client device 190 can be a computer, a display, or a fitness tracker. The client device 190 can notify the user to begin exerting the pulling force 160, and later to stop exerting the pulling force 160. For example, the client device 190 can display a notification or generate a sound requesting the user to begin exerting the pulling force 160. The client device 190 can also request that the user stops exerting the pulling force 160 after a predetermined amount of time, or after the client device 190 collects a predetermined amount of data from the force sensors 180. The client device 190 can receive, from the force sensor 180, the values corresponding to the force exerted on the force sensor 180. The client device 190 can communicate with the force sensor 180 via a network, a wired connection, or a wireless connection. The client device 190 can determine the force exerted on the force sensor 180 from the values received from the force sensor 180. The client device 190 can display the force in a graphical user interface displayed on a screen of the client device 190. The client device 190 can also transmit the force values to another system or device. For example, the client device 190 can transmit the force to a fitness tracker via Bluetooth.

When the user stands on the force sensors 180A-180B while wearing the belt 150 connected to the plate 120B via the strap 140 and hook 130, the user can exert the pull force 160 away from the plate 120B. Since the user is standing on the force sensors 180A-180B mounted on the plate 120B, the user would simultaneously exert the pushing forces 165A-B on the force sensors 180A-180B. For example, the user can exert the push force 165A on the force sensor 180A with one leg, and the push force 165B on the force sensor 180B with their other leg.

Although the testing system 170 illustrated in FIG. 1B depicts two force sensors 180, one for each leg, it is contemplate that the training system 110 can accommodate any number of push forces 165 from the user. For example, a disabled user may exert only one push force 165 on one force sensor 180 or any number of push forces 165 on a corresponding number of force sensors 180.

Figure 2:
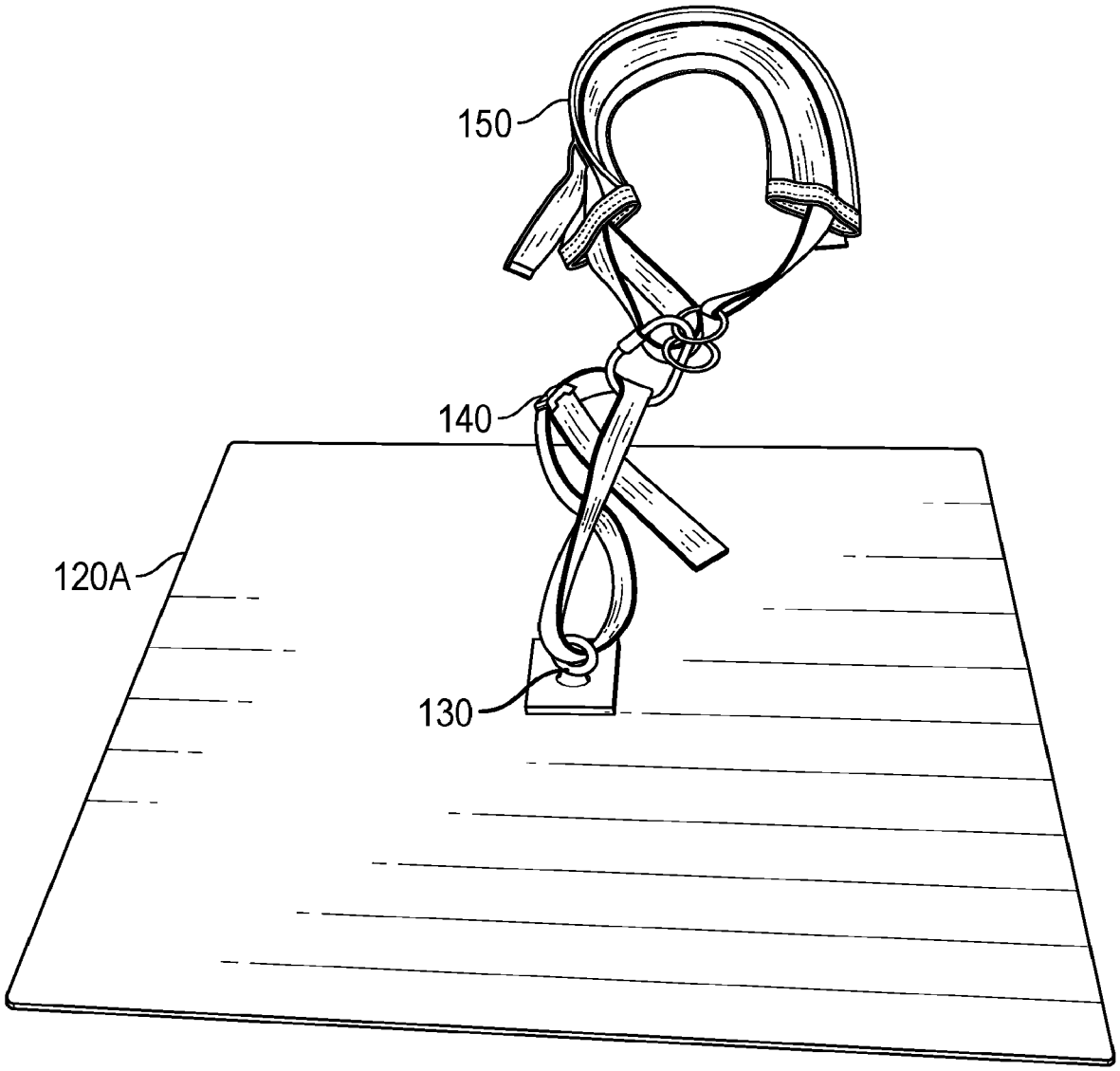
FIG. 2 illustrates a view of the belt attached to the strap, which is attached to the hook of the plate in an exemplary embodiment of the system for training lower extremities.

Referring now to FIG. 2, FIG. 2 illustrates a view of the plate 120A, hook 130, strap 140, and belt 150 in an exemplary embodiment of the training system 110. By having the training system 110 have individual parts, the user can replace parts or position themselves according to their preferences. For example, the user can replace the belt or choose a preferred belt without modifying the training system 110. The belt 150 may be attached to the strap 140, which may attach to the hook 130 of the plate 120A in an exemplary embodiment of the training system 110. For example, the user can attach the hook 130 to the strap 140 and then attach the strap 140 to the belt 150. Then the user could stand on the plate 120A and secure the belt 150 to their waist to use the training system 110.

Figure 3:
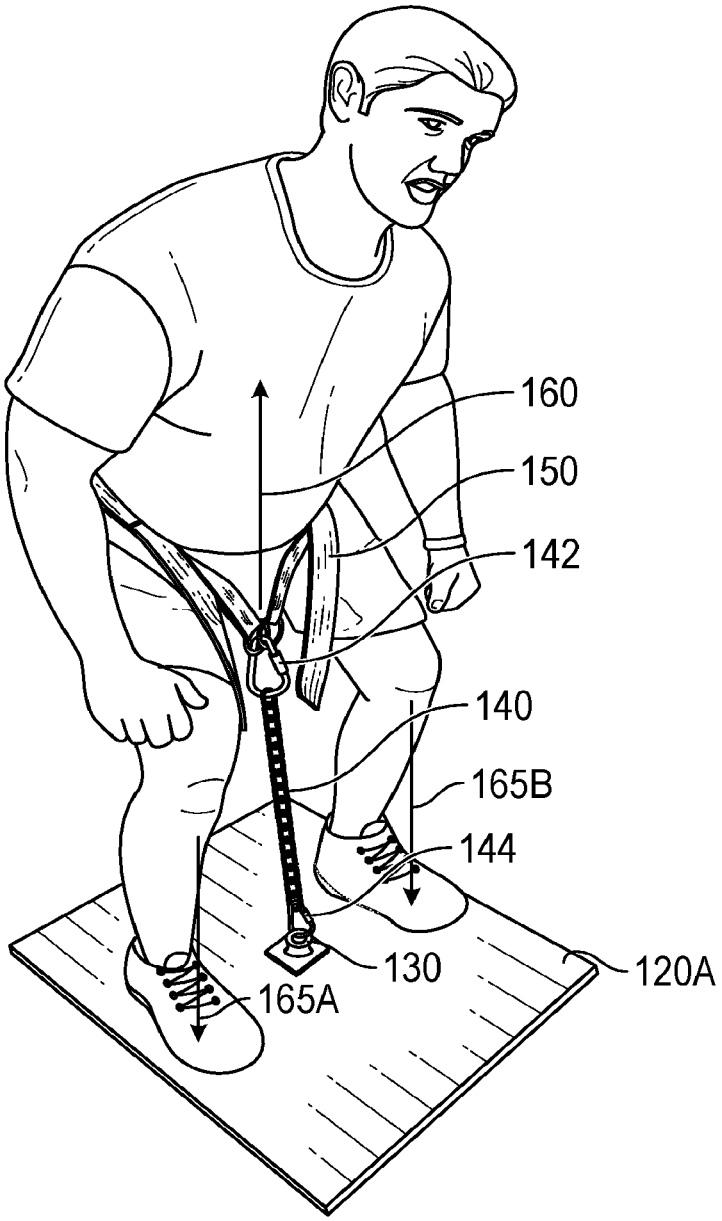
FIG. 3 illustrates a view of the user performing an IMTP by exerting a pulling force on the plate, which causes the user to exert a pushing force on the plate in an exemplary embodiment of the system for training lower extremities.

Referring now to FIG. 3, FIG. 3 illustrates a view of the user performing an IMTP by exerting the pulling force 160 on the plate 120A, which causes the user to exert the pushing forces 165 on the plate 120A in an exemplary embodiment of the training system 110. By having the belt 150 around their midsection, the user can use their lower extremities, such as the thigh muscles, to exert a pulling force and thus exert a pushing force on the plate 120A.

Figure 4:
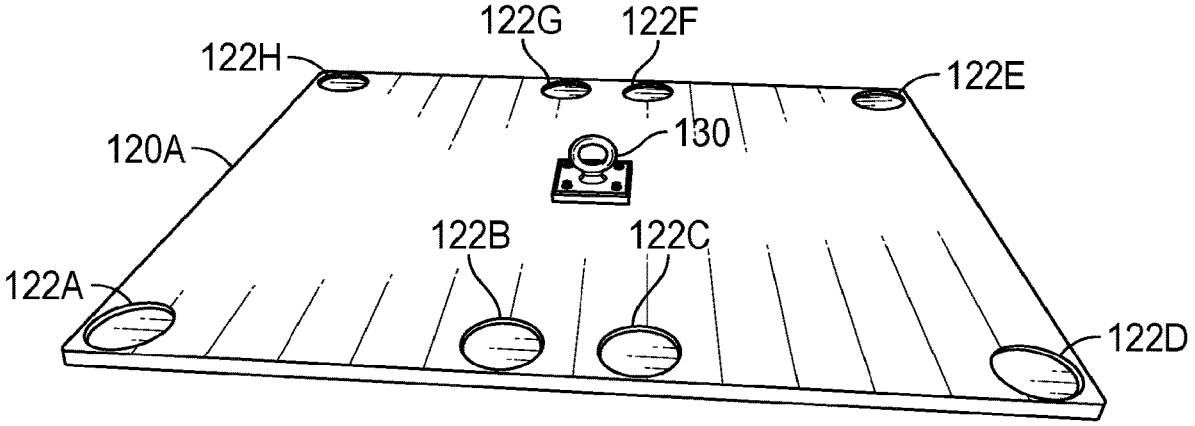
FIG. 4 illustrates a view of the plate having mounting holes in an exemplary embodiment of the system for testing lower extremities.

Referring now to FIG. 4, FIG. 4 illustrates a view of the plate 120B having receivers 122A-122H in an exemplary embodiment of the testing system 170. The receivers 122A-122H can each have a depth such that each receiver 122 forms an inner cylinder in the plate 120B for receiving corresponding mounts 182. Further, a coupling link and/or a quick link may be attached to the strap 140. For example, a coupling link may be disposed between the strap 140 and the belt 150 and a quick link may be disposed between the strap 140 and hook 130. The quick link may be configured to easily attach and reattach to the hook 130, while also maintaining a secure and safe connection to the hook 130.

Figure 5:
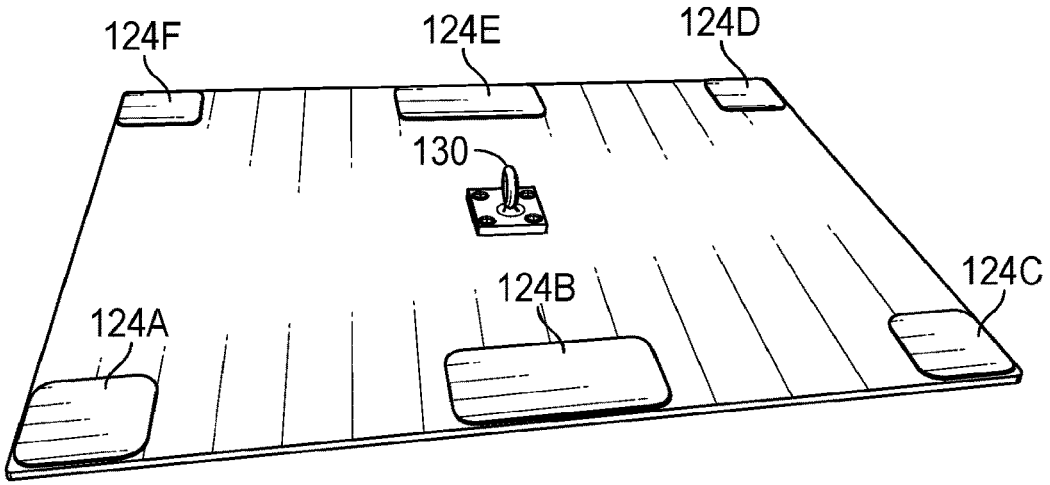
FIG. 5 illustrates a view of the plate having a plurality of receiving surfaces in an exemplary embodiment of the system for testing lower extremities.

Referring now to FIG. 5, FIG. 5 illustrates a view of the plate having receiving surfaces disposed on the plate surface. The receiving surfaces may be a friction enhancing material and/or a grip tape. Each section of grip tape may be positioned on the plate 120 to accept the mounts 182 of the force sensors 180. In one embodiment, the plate 120 may include six grip tape sections, wherein four of the grip tape sections are positioned in the corners of the upper surface of the plate 120 and two of the grip tape sections are positioned equidistant from the corner sections of the grip tape along the length of the plate 120. The two sections of grip tape may comprise a greater surface area such that these two sections of grip tape may accept two mounts (for example, one mount from each force sensor).

Figure 6A:
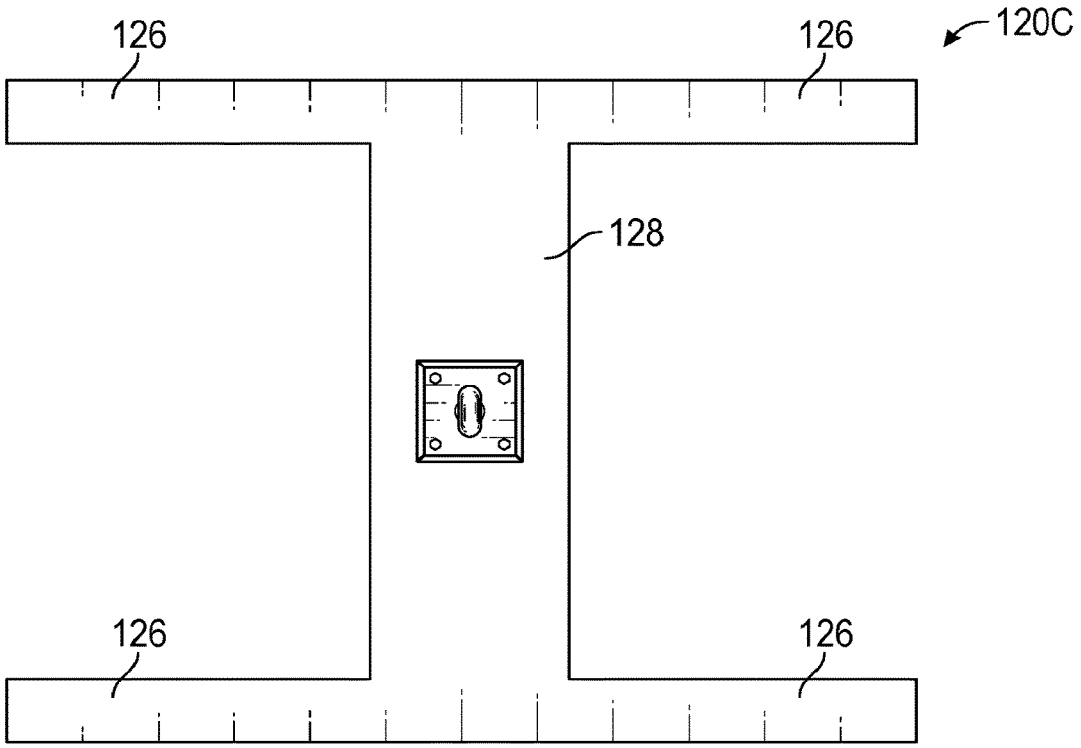
FIGS. 6A-6B illustrate views of embodiments of plates with reduced footprints.
Figure 6B:
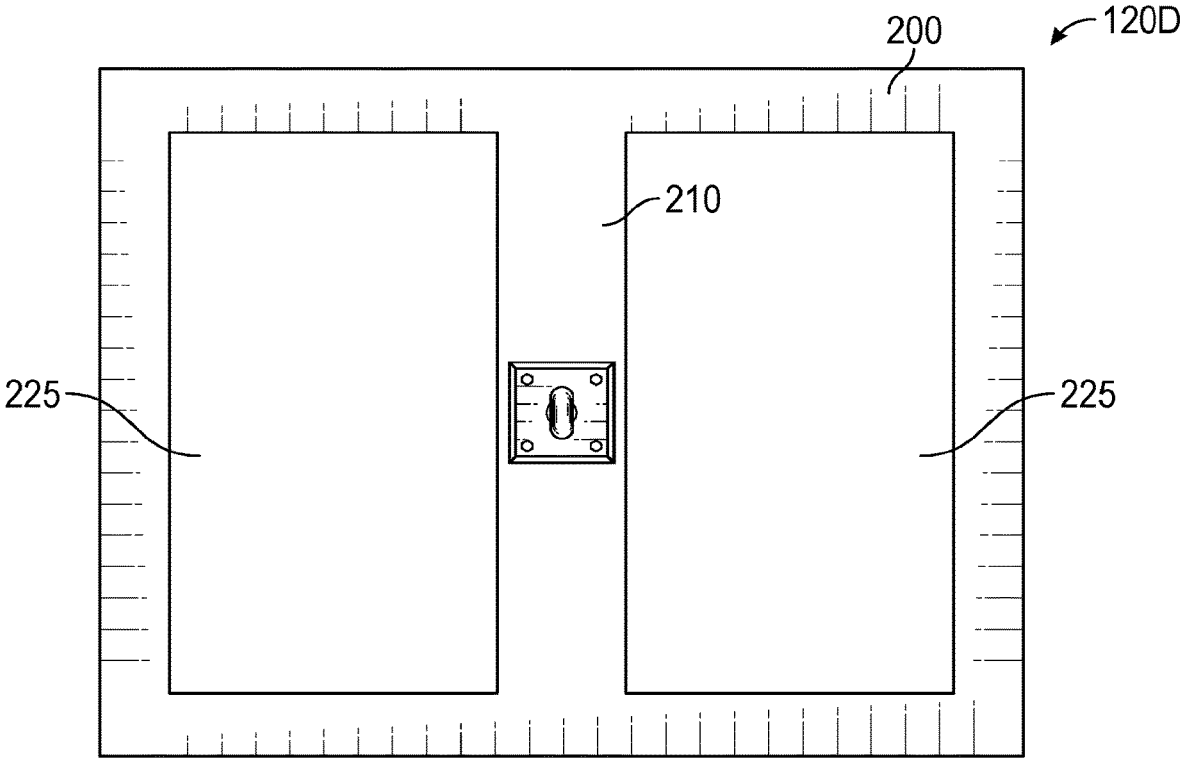

Referring not to FIGS. 6A-6B, FIGS. 6A-6B illustrate view of the plates having reduced footprints. The plate 120C may include a central section and one or more wings. Accordingly, the wings may be sized to accept the mounts of the force sensors. Thus, the a gap may exist between opposite swings, for example, to reduce the weight and footprint of the plate 120C while maintaining a sufficient surface area to accept the force sensors. The plate 120D may include one or more apertures. In such an embodiment, plate 120D comprises a central section and a perimeter. The central section may be configured to accept the hook 130 and the perimeter may be sized to accept the mounts of the force sensors. Accordingly, the plate 120D may be a structurally sound member sized to accept one or more force sensors, yet a reduced weight and foot print.

Figure 7:
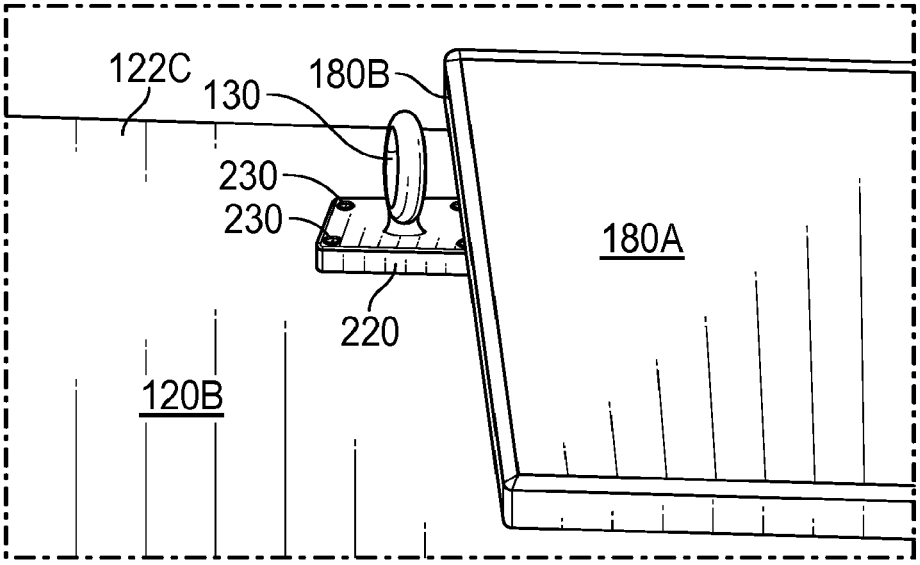
FIG. 7 illustrates a side view of the plate having mounts and attached to the force sensor in an exemplary embodiment of the system for testing lower extremities.

Referring now to FIG. 7, FIG. 7 illustrates a side view of the plate 120B having receivers 122 and attached to the force sensor 180A in an exemplary embodiment of the testing system 170. In the exemplary embodiment, since the hook 130 is on the plate 120B between the force sensor 180A and the receiver 122C for the force sensor 180B, the strap 140 can attach to the hook 130 without interfering with the force sensors 180. In an embodiment, the system may comprise the plate 120B, the hook 130, the receivers 122, and the force sensor 180B. The force sensor 180A is on the plate 120B. The remaining receivers 122 can receive the mounts 182 of the force sensor 180B. In an embodiment, the hook 130 is positioned such that the plane of the hook 130 eye is parallel to the force sensors. Accordingly, by positioning the hook 130 parallel to the force sensors, the force sensors may clear the hook 130.

Figure 8:
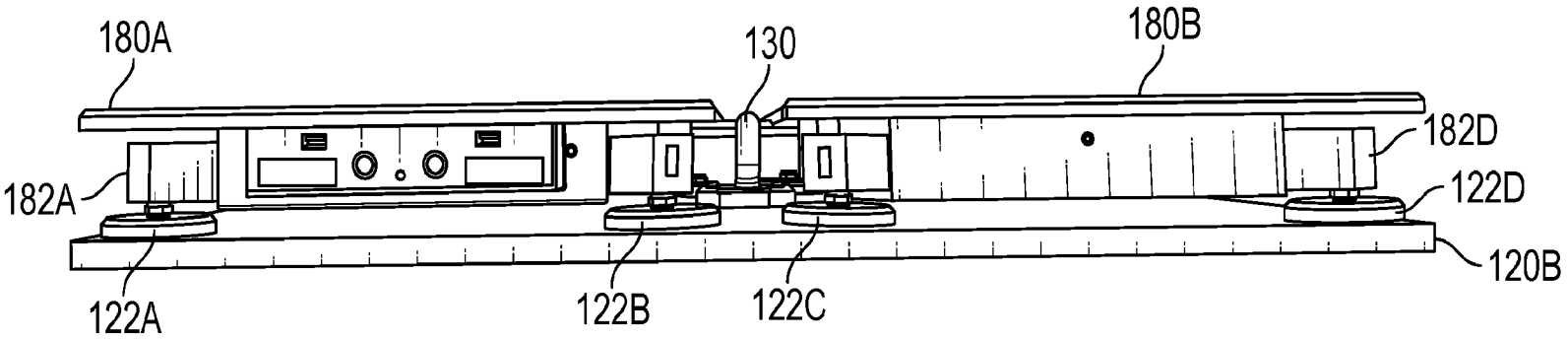
FIG. 8 illustrates a side view of the plate, the receivers, the hook, the force sensor, and the mounts of the system for testing lower extremities.

Referring now to FIG. 8, FIG. 8 illustrates a side view of the plate 120B, the receivers 122, the hook 130, the force sensors 180, and the mounts 182 of the testing system 170. In the exemplary embodiment, a user can step on the force sensors 180 and then attach themselves to the plate 120B via the hook 130 exposed between the force sensors 180.

Figure 9:
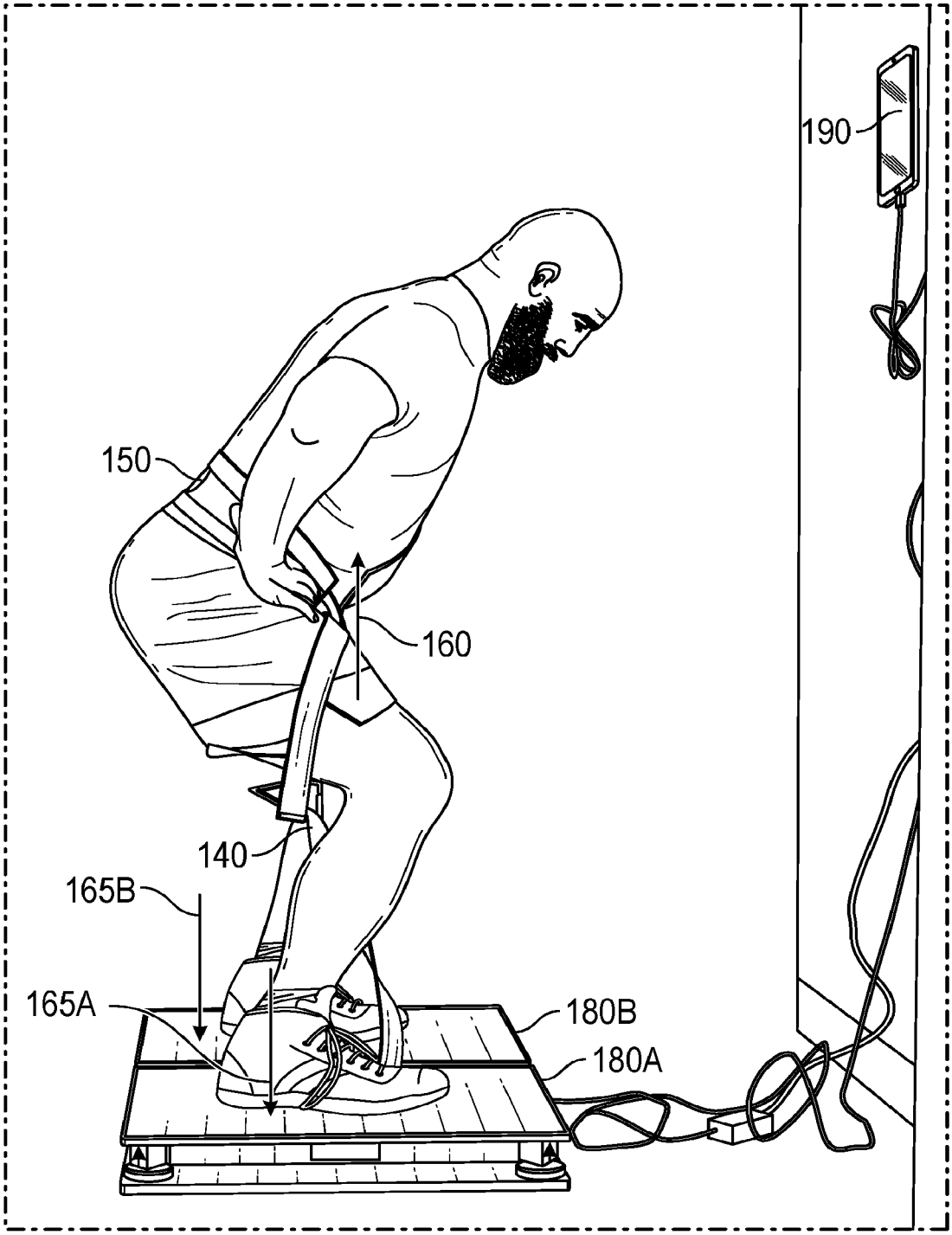
FIG. 9 illustrates a view of the user performing the IMTP by exerting the pulling force on the plate, which causes the force sensors to transmit measurements of the corresponding push forces to the client device in an exemplary embodiment of the system for testing lower extremities.

FIG. 9 illustrates a view of the user performing the IMTP by exerting the pulling force 160 on the plate 120B, which causes the force sensors 180 to transmit measurements of the corresponding push forces 165 to the client device 190 in an exemplary embodiment of the testing system 170. The client device 190 display a total of the push forces 165 exerted by the user. The client device 190 can display the total as a unit of measurement such as Newton's.

Figure 10:
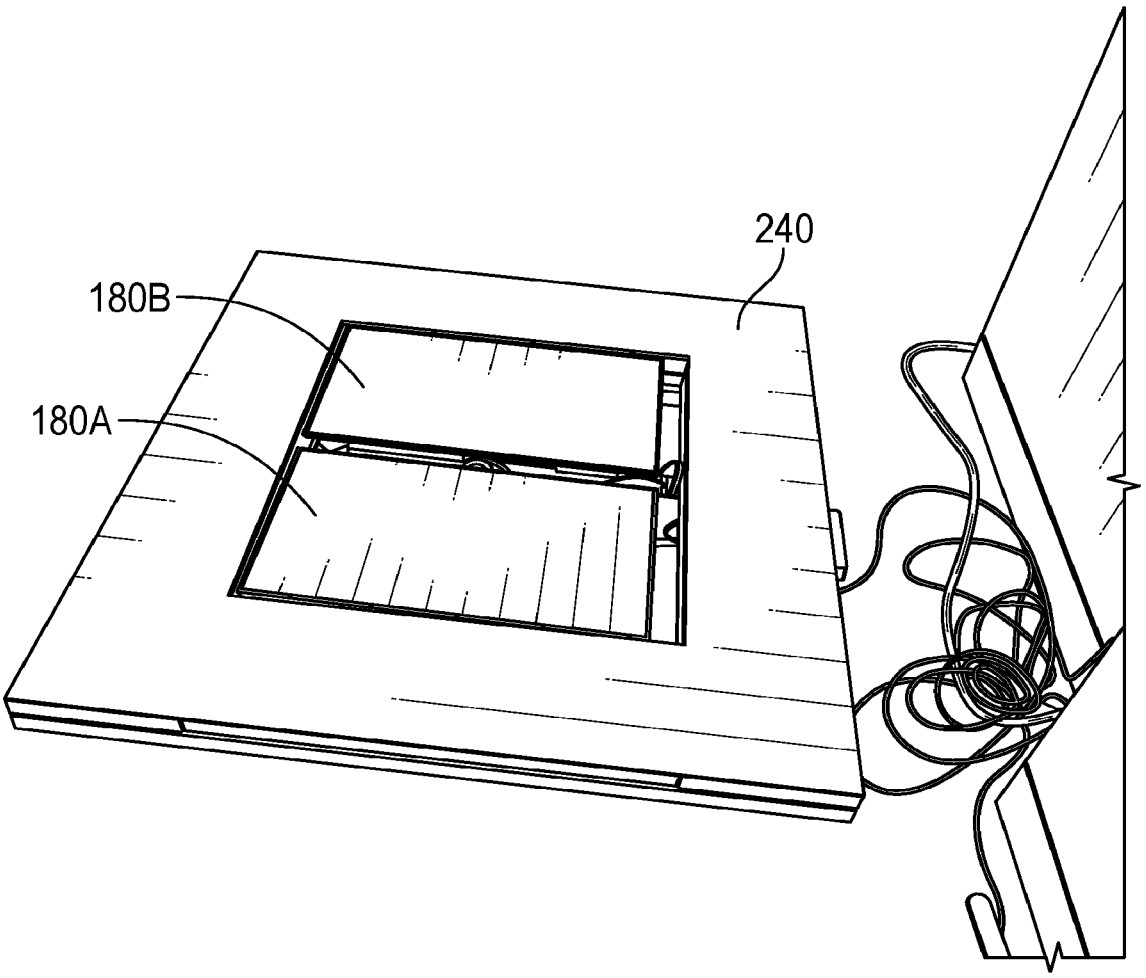
FIG. 10 illustrates a view of an embodiment of the system further comprising a border.

Referring now to FIG. 10, FIG. 10 illustrates a further embodiment of the system comprising a border. The border may be a annular member surrounding the perimeter of the plate 120 and/or force sensors. The border may be sized to have the same height as the top surface of the force sensors. Accordingly, the border may be configured to act as a safety feature. For example, the border may provide a surface for the user to step upon after operating the force sensors. Additionally, the border may be a surface that reduces the likelihood of the user injuring themselves while jumping on the force sensors.

Figure 11:
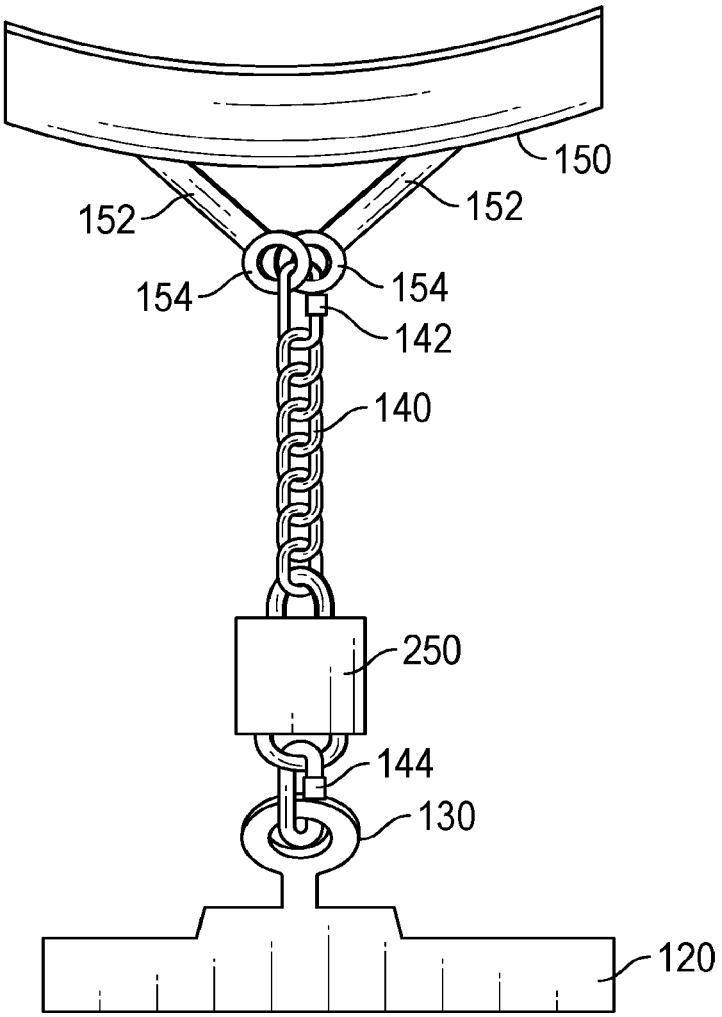
FIG. 11 illustrates a view of the system including an inline force sensor.

Referring now to FIG. 11, FIG. 11 illustrates an alternate embodiment of the system including an inline force sensor. In such an embodiment, belt 150 may be tethered to a coupling link. The coupling link may be coupled to a strap 140 (for example, a chain). Further, the strap 140 may be attached to an inline force sensor and the inline force sensor may be further connected to a quick link. The quick link may be reversibly attached to the hook 130. Thus, when the user exerts a downward force, the inline force sensor may determine the magnitude of such a force. In this way, the inline force sensor may determine and transmit data in a manner similar to that of the force sensors. Accordingly, in such an embodiment comprising the inline force sensor, the testing system 170 may not include force sensors. Thus, the testing system 170, in this alternate embodiment, may function with the plate 120A.

The client device 190 can also notify the user when to begin exerting the pulling force 160 and when to stop exerting the pulling force 160.

Various elements, which are described herein in the context of one or more embodiments, may be provided separately or in any suitable subcombination. Further, the processes described herein are not limited to the specific embodiments described. For example, the processes described herein are not limited to the specific processing order described herein and, rather, process blocks may be re-ordered, combined, removed, or performed in parallel or in serial, as necessary, to achieve the results set forth herein.

It will be further understood that various changes in the details, materials, and arrangements of the parts that have been described and illustrated herein may be made by those skilled in the art without departing from the scope of the following claims.

All references, patents and patent applications and publications that are cited or referred to in this application are incorporated in their entirety herein by reference. Finally, other implementations of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. A lower extremity training system comprising:

a plate comprising:

an upper surface, a strap reversibly coupled to the plate, the strap comprising a fixed length, the strap vertically reversibly coupled to a user via a belt, and a lower surface, wherein the lower surface is configured to interface with a floor;

one or more grip sections disposed upon the upper surface, the one or more grip sections configured to accept one or more mounts;

one or more force sensors coupled to the one or more mounts.

2. The lower extremity training system of claim 1, further comprising:

a hook orthogonal to the upper surface, wherein the strap is reversibly coupled to the plate via the hook; and the belt reversibly coupled to the strap, the belt sized to conform to a waist of the user, wherein a pull force, originating at the belt, exerted away from the upper surface induces one or more push forces towards the upper surface.

3. The lower extremity training system of claim 2, wherein the strap is reversibly coupled to the hook via a quick link, and wherein the quick link is disposed between the strap and the hook.

4. The lower extremity training system of claim 3, wherein the strap is reversibly coupled to the belt via a coupling link, and wherein the coupling link is disposed between the strap and the belt.

5. The lower extremity training system of claim 2, wherein the one or more force plates are comprised of:

a first force plate; and a second force plate, the first force plate disposed upon a first half of the upper surface, and the second force plate disposed upon a second half of the upper surface, wherein the hook is disposed between the first force plate and the second force plate such that the user may access said hook.

6. The lower extremity training system of claim 1, wherein the strap is a chain.

7. The lower extremity training system of claim 6, further comprising a base disposed between the hook and the plate, the base further comprising one or more mounting holes and a hook hole, wherein the one or more mounting holes are threaded such as to accept one or more fasteners, one or more fasteners are configured to affix the base to the plate, and wherein the hook hole is sized to accept the hook.

8. A lower extremity training system comprising:

a plate comprising:

a perimeter;

a central section disposed within the perimeter;

an upper surface;

a lower surface, the lower surface configured to interface with a floor;

one or more apertures, each of the one or more apertures defined and bound by the perimeter and the central section, each of the one or more apertures traversing the upper surface to the lower surface; and one or more mounts configured to be accepted by the perimeter, and one or more force sensors coupled to the one or more mounts.

9. The lower extremity training system of claim 8, further comprising:

a hook disposed upon the central section;

a strap reversibly coupled to the hook; and a belt reversibly coupled to the strap, the belt sized to conform to a waist of a user, wherein the strap includes a fixed length, and wherein a pull force, originating at the belt, exerted away from the upper surface induces one or more push forces towards the upper surface.

10. The lower extremity training system of claim 9, wherein the hook is orthogonal to the upper surface.

11. The lower extremity training system of claim 9, wherein the strap is reversibly coupled to the hook via a quick link, and wherein the quick link is disposed between the strap and the hook.

12. The lower extremity training system of claim 9, wherein the strap is reversibly coupled to the belt via a coupling link, and wherein the coupling link is disposed between the strap and the belt.

13. The lower extremity training system of claim 9, wherein the one or more force sensors is an inline force sensor, wherein the inline force sensor is coupled to the strap.

14. The lower extremity training system of claim 9, further comprising:

a base disposed between the hook and the plate.

15. The lower extremity training system of claim 14, the base further comprising:

one or more mounting holes, wherein the one or more mounting holes are threaded such as to accept one or more fasteners, the one or more fasteners configured to affix the base to the plate; and a hook hole, wherein the hook hole is sized to accept the hook.

16. The lower extremity training system of claim 9, wherein the one or more force sensors are configured to sense the one or more push forces and determine a magnitude of the one or more push forces.

17. The lower extremity training system of claim 8, further comprising a client device in electrical communication with the one or more force sensors, wherein the client device is configured to display a user interface, and wherein the user interface comprises one or more metrics, the one or more metrics being a function of the magnitude of the one or more push forces.

18. A lower extremity training system comprising:

a plate comprising an upper surface and a lower surface;

one or more mounts configured to be accepted by the plate;

one or more force sensors coupled to the one or more mounts;

a strap comprising a fixed length;

a belt reversibly coupled to the strap, the belt sized to conform to a waist of a user; and one or more grip sections disposed on the plate, and the one or more grip sections configured to accept the one or more mounts.

19. The lower extremity training system of claim 18, further comprising a hook orthogonal to the upper surface, wherein a pull force, originating at the belt, exerted away from the upper surface induces one or more push forces towards the upper surface.

20. The lower extremity training system of claim 18, wherein the strap is a chain.

* * * * *